US006417822B1

(12) United States Patent
Sasaki et al.

(10) Patent No.: US 6,417,822 B1
(45) Date of Patent: Jul. 9, 2002

(54) DISPLAY DEVICE AND DRIVING METHOD THEREOF

(75) Inventors: Takashi Sasaki, Hiratsuka; Seiichi Yasumoto, Itabashi-ku; Kunio Ando; Masaji Ishigaki, both of Yokohama; Michitaka Ohsawa, Fujisawa; Takeo Masuda, Yokohama; Keizo Suzuki, Kodaira; Masatoshi Shiiki, Musashimurayama, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/160,072

(22) Filed: Sep. 24, 1998

(30) Foreign Application Priority Data

Sep. 29, 1997 (JP) ..... 9-263182

(51) Int. Cl.[7] ..... G09G 3/20

(52) U.S. Cl. ..... 345/55; 345/56; 345/57; 345/58; 345/59; 345/60; 345/600; 345/605

(58) Field of Search ..... 345/55, 56, 57, 345/58, 59, 60, 600, 605

(56) References Cited

U.S. PATENT DOCUMENTS 4,881,068 A * 11/1989 Korevaar et al. ..... 340/766
5,661,500 A * 8/1997 Shinoda et al. ..... 345/60
5,963,184 A * 10/1999 Tokunaga et al. ..... 345/60
6,023,258 A * 2/2000 Kuriyama et al. ..... 345/60
6,300,923 B1 * 10/2001 Havel ..... 345/83

FOREIGN PATENT DOCUMENTS

| | | |
|---|---|---|
| EP | 0655722 | 5/1995 |
| FR | 2656716 | 7/2001 |
| JP | 09081073 | 3/1997 |

* cited by examiner

*Primary Examiner*—Richard Hjerpe
*Assistant Examiner*—Jean Lesperance
(74) *Attorney, Agent, or Firm*—Mattingly, Stanger & Malur, P.C.

(57) ABSTRACT

In an operation of an address period for addressing cells of a display device, such as a plasma display panel, comprising a plurality of cells of three kinds, red (R), green (G), blue (B), which are arranged on a plane for forming a display surface thereof, in which each of said cells comprising: a pair of transparent electrodes provided in parallel to each other; an address electrode being positioned opposing the pair of transparent electrodes; luminescence medium provided on the address electrode; and a discharge space being defined between the pair of transparent electrodes and said fluorescence medium on the address electrode, wherein the address discharge is conducted by applying an address voltage to the address electrode, and the address voltage applied is determined depending upon the each kind of the cells, R, G and B.

20 Claims, 9 Drawing Sheets

DISPLAY DEVICE AND DRIVING METHOD THEREOF

BACKGROUND OF THE INVENTION

1. Field of the Invention

The present invention relates to a display device, including such as a display device for use in a personal computer and a work station or the like, a flat type television receiver which can be hanged on a wall, and a display panel for displaying advertisement and information, etc. thereon, in particular utilizing such as a plasma display panel, and further relates to a driving method for driving such the display device.

2. Description of Prior Art

In a conventional A-C type plasma display device, in particular, in an address-display separation type, address discharges for addressing and regulating pixels (i.e., cells) to emit light are caused simultaneously on a vertical one line (for each of colors, red (R), green (G), and blue (B)), and voltage applied to an address electrode is also made constant irrespective of the difference in colors, as is disclosed, for example, in Japanese Patent Laying-Open No. Hei 3-90415 (1991). Further, the voltage which is applied to the address electrode in advance to the address discharge, during a reset period for initializing an electric charging condition for each of the cells, is also constant irrespective of the colors, R, G and B.

However, an appropriate voltage for the address discharge differs depending upon the kind or sort of luminescence medium, such as fluorescence material which is provided on an address electrode, or depending upon the discharge characteristic of the address electrode of the each cell including the difference of the material in the luminescence medium. Therefore, there are drawbacks that when the voltage applied to the each address electrode is made constant, a range of voltage for achieving a stable display comes to be narrow, and that the kinds of the luminescence medium of such as the fluorescence material which can be selected are restricted.

SUMMARY OF THE INVENTION

An object of the present invention is, therefore, for dissolving the drawbacks in the above-mentioned conventional art, to provide a display device and a driving method thereof, eliminating failure in discharge of the address electrode, thereby obtaining a stable display of a picture with high quality.

And, an another object, in accordance with the present invention, is to provided a display device and a driving method thereof, with which, especially circuit elements for driving electrodes of the display device can be cheaply constructed with low cost since the voltage-resistance necessary for driver elements is reduced down in sufficient and/or a voltage source is used in common in the circuitry construction thereof.

For achieving the objects mentioned in the above, according to the present invention, first of all, there is provided a display device, comprising a plurality of cells of plural kinds which are arranged on a plane for forming a display surface thereof, in which each of said cells comprising:

a pair of electrodes provided in parallel to each other;

an address electrode being positioned opposing said pair of transparent electrodes;

luminescence medium being provided on said address electrode; and a discharge space being defined between said pair of transparent electrodes and said fluorescence medium on said address electrode, and said display device further comprising, a driving means for applying address voltages to said address electrodes of said plural cells thereby causing charges for addressing display of said cells, wherein said driving means comprises means for applying to said address electrodes of said cells the address voltages being different depending upon discharge characteristics of said cells.

And according to the present invention, it is referable, in the display device as described in the above, that said cells are plural in kinds of the luminescence mediums provided therein, and that said address voltage applying means of said driving means apples to said address electrodes of said cells the address voltages being corresponding to discharge characteristics different depending upon the kinds of said cells.

Further, according to the present invention, it is preferable, in the display device as described in the above, that said address voltages applied from said address voltage applying means to said address electrodes are for addressing non-display of said cells instead of for addressing the display thereof, and further that said cells are in three kinds, red (R), green (G) and blue (B), or more depending upon the luminescence mediums provided therein, and further said address voltage applying means applies to at least two of them with the address voltages being different to each other.

Moreover, according to the present invention, it is preferable, in the display device as described in the above, that said luminescence medium in each of said cells is fluorescence material, and further that said address voltages applied from said address voltage applying means to said address electrodes of said cells for addressing are determined corresponding to the discharge characteristics being different depending upon of the kind of said fluorescence materials of said cells.

And also according to the present invention, it is also preferable, in the display device as described in the above, that the address voltages applied to said address electrodes of said cells for addressing are determined to be higher than break-down voltages which are inherent to said plural kinds of said cells.

Further also, according to the present invention, it is also preferable, in the display device as described in the above, that at least a part of said pair of electrodes in each of said cells are made of transparent electrodes, and said address electrode is provided in a direction orthogonal to that of said pair of transparent electrodes.

And also, moreover, according to the present invention, it is preferable, in the display device as described in the above, that each of the address voltages applied from said address voltage applying means to said address electrodes comprises an address pulse which is generated corresponding to an address period in an operation and an over-all pulse which is generated corresponding to a sustain period, and at least said address pulse is determined depending upon the discharge characteristic of said cell to be addressed.

Furthermore, according to the present invention, it is preferable, in the display device as described in the above, that said over-all pulse of the address voltage applied from said address voltage applying means to said each address electrode is determined depending upon the discharge characteristic of said cell to be addressed, or that the address voltage applied from said address voltage applying means to said each address electrode is further biased by a predetermined bias potential in period other than that where said address pulse is turned on in said address period, or that said address voltage applied from said address voltage applying means to said each address electrode further includes an address reset pulse which is generated corresponding to a rest period in advance to the address period, and said address reset pulse is also set at a voltage depending upon discharge characteristic of said cell to be addressed, thereby enabling the cost-down of the display device, in particular the circuitry construction thereof.

In addition thereto, for achieving the objects mentioned in the above, according to the present invention, there is also provided a driving method of a display device comprising a plurality of cells of plural kinds which are arranged on a plane for forming a display surface thereof, in which each of said cells comprising:

a pair of electrodes provided in parallel to each other;

an address electrode being positioned opposing said pair of transparent electrodes;

luminescence medium being provided on said address electrode; and a discharge space being defined between said pair of transparent electrodes and said fluorescence medium on said address electrode, wherein address voltages are applied to said address electrodes of said plural cells for causing charges for addressing display of said cells, wherein the address voltages applied are different depending upon discharge characteristics of said cells.

And, according to the present invention, it is preferable, in the driving method of a display device as described in the above, that said cells are plural in kinds of the luminescence mediums provided therein, and to said address electrodes of said cells are applied with the address voltages being corresponding to discharge characteristics different depending upon the kinds of said cells.

Further, according to the present invention, it is preferable, in the display device as described in the above, that said address voltages applied are for addressing non-display of said cells instead of for addressing the display thereof, or that said cells are in three kinds, red (R), green (G) and blue (B), or more depending upon the luminescence mediums provided therein, and to at least two of them are applied with the address voltages being different to each other.

Moreover, according to the present invention, it is preferable, in the driving method of a display device as described in the above, that said luminescence medium in each of said cells is fluorescence material, and said address voltages applied from said address voltage applying means to said address electrodes of said cells for addressing are determined corresponding to the discharge characteristics being different depending upon of the kind of said fluorescence materials of said cells.

And also according to the present invention, it is preferable, in the driving method of a display device as described in the above, that the address voltages applied to said address electrodes of said cells for addressing are determined to be higher than break-down voltages which are inherent to said plural kinds of said cells.

Further also, according to the present invention, it is also preferable, in the driving method of a display device as described in claim 13, that each of the address voltages applied from said address voltage applying means to said address electrodes includes an address pulse which is generated corresponding to an address period in an operation and an over-all pulse which is generated corresponding to a sustain period, and at least said address pulse is determined depending upon the discharge characteristic of said cell to be addressed, or that said over-all pulse of the address voltage applied to said each address electrode is determined depending upon the discharge characteristic of said cell to be addressed, or that the address voltage applied to said each address electrode is further biased by a predetermined bias potential in period other than that where said address pulse is turned on in said address period, or that said address voltage applied to said each address electrode further includes an address reset pulse which is generated corresponding to a rest period in advance to the address period, and said address reset pulse is also set at a voltage depending upon discharge characteristic of said cell to be addressed, thereby enabling the cost-down of the display device, in particular the circuitry construction thereof.

DETAILED DESCRIPTION OF PREFERRED EMBODIMENTS

Hereinafter, embodiments of a display device and a driving method thereof, according to the present invention, will be fully explained by referring to the attached drawings, FIGS. 1 to 11.

Figure 2:
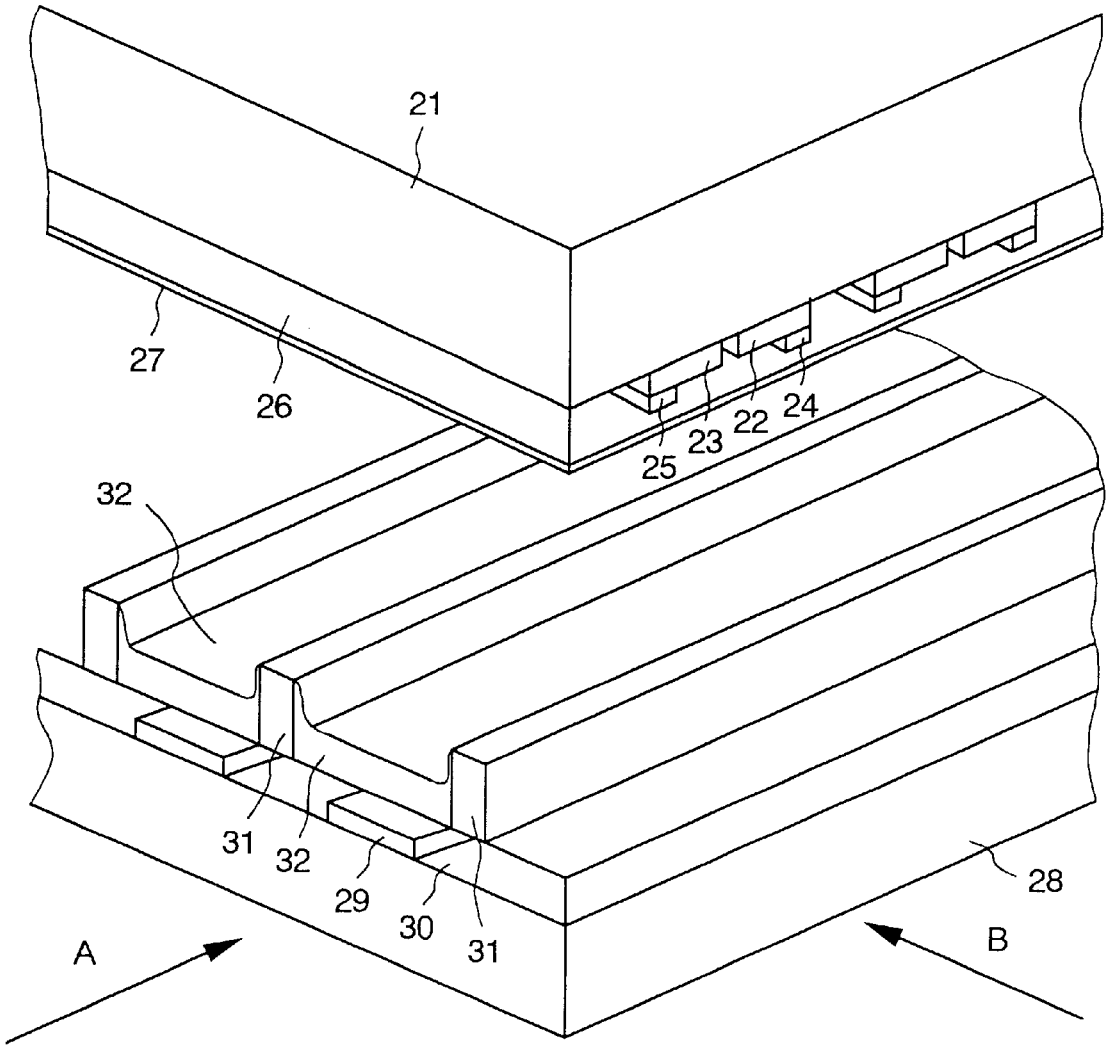
FIG. 2 shows an enlarged perspective view, including a partial cross-section view thereof, of a portion of structure of a plasma display panel according to the present invention.

FIG. 2 shows an enlarged perspective view, including a partial cross-section view, of a portion of structures of a plasma display panel according to the present invention. In the figure, upon an under surface of a front glass substrate 21 is provided or attached a transparent X electrode 22 and a transparent Y electrode 23 in parallel. Further, those electrodes are piled up with a X bus electrode 24 and a Y bus, electrode 25, respectively. Furthermore, covering over the under surface of them are provided or disposed a dielectric layer 26 and a protection layer 27 of such as MgO or the like, in sequence. On the contrary, upon an upper surface of the back or rear glass substrate 28 is provided or attached an address A electrode 29 extending in an orthogonal direction to that of the X electrode 22 or the transparent Y electrode 23 on the front glass substrate 21. A layer of dielectric 30 covers over the address A electrode 29, and further on it are also provided partition walls 31 at both sides thereof, in parallel to the address A electrode 29. Furthermore, over the partition walls 31 and the dielectric layer 30 formed on he address A electrode 29, there is pasted or applied a fluorescence material 32 as a medium for light emission luminescence medium).

Figure 3:
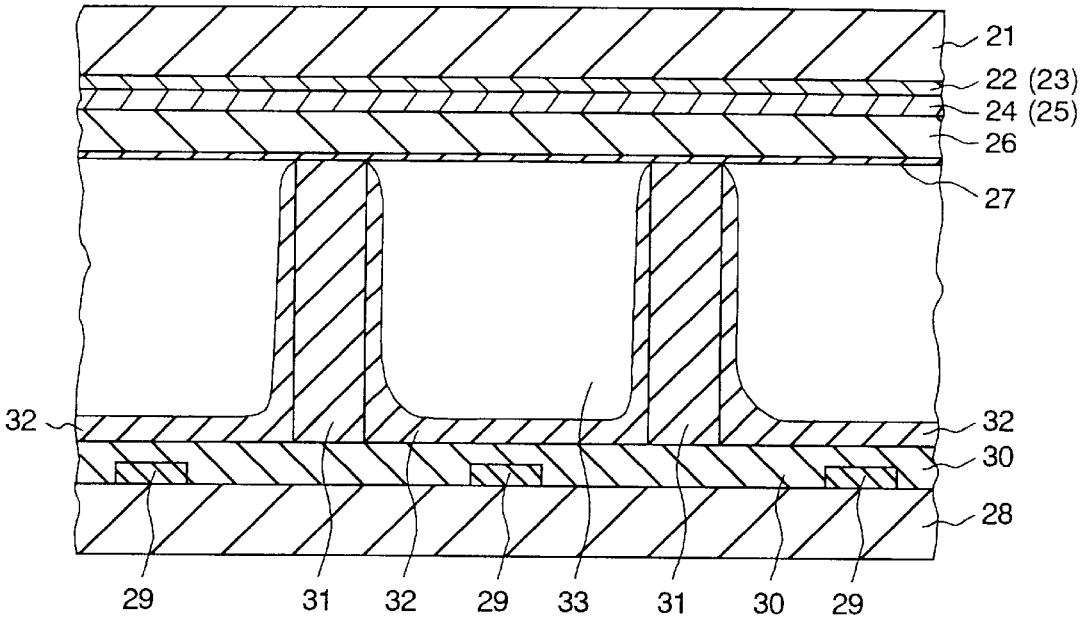
FIG. 3 shows a cross-section view of cells of the plasma display panel, seeing in a direction of an arrow A in FIG. 2.

FIG. 3 shows a cross-section view of three (3) cells of the plasma display panel, seeing in a direction of an arrow A in FIG. 2. The address A electrode 29 is located in a middle of the partition walls 31, and one piece of the address A electrode 29 is provided for each color of the fluorescence material. Here, in the present embodiment, three (3) kinds of fluorescence materials are pasted in an order of red (R), green (G) and blue (B), from a left-hand side for instance. Further, in spaces 33 defined between the front glass substrate 21 and the rear glass substrate 28 is filled up with a discharge gas, such as Ne, Xe, etc.

Figure 4:
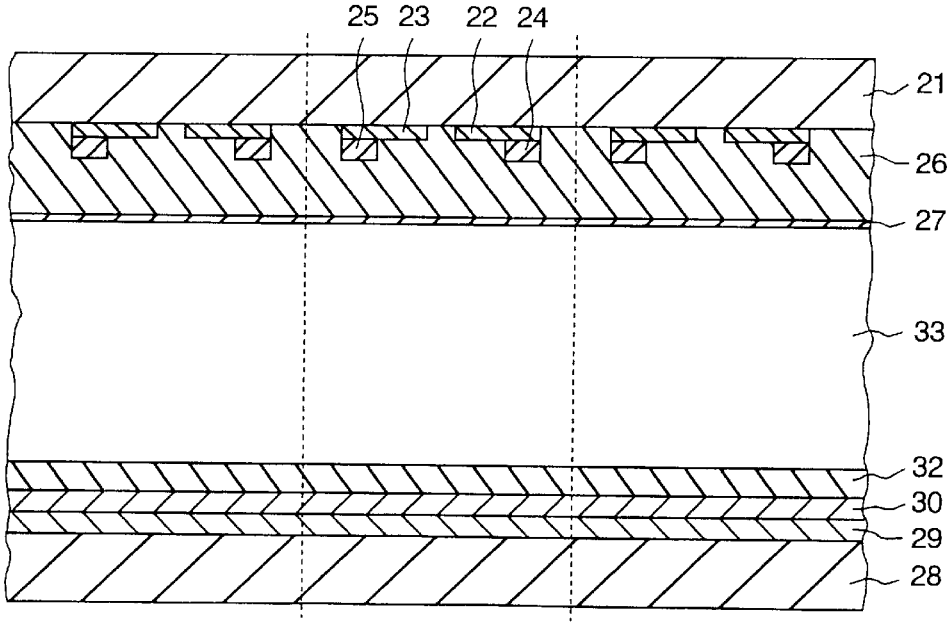
FIG. 4 shows a cross-section view of cells of the plasma display panel, but seeing in a direction of an arrow B in FIG. 2.

FIG. 4 shows a cross-section view of three (3) cells of the plasma display panel, but seeing in a direction of an arrow B in FIG. 2. Boundaries of the single cell is roughly defined or located as indicated by a dotted line in the figure, and the X electrode 22 and the Y electrode 23 are disposed one by one in the single cell. In a plasma display panel of, in particular, an A-C type, positive and negative electric charges are gathered or accumulated separately on or around the dielectric layer in a vicinity of the X electrode 22 and the Y electrode 23, respectively, thereby forming respective electric fields for discharges by use of the charges accumulated.

Figure 5:
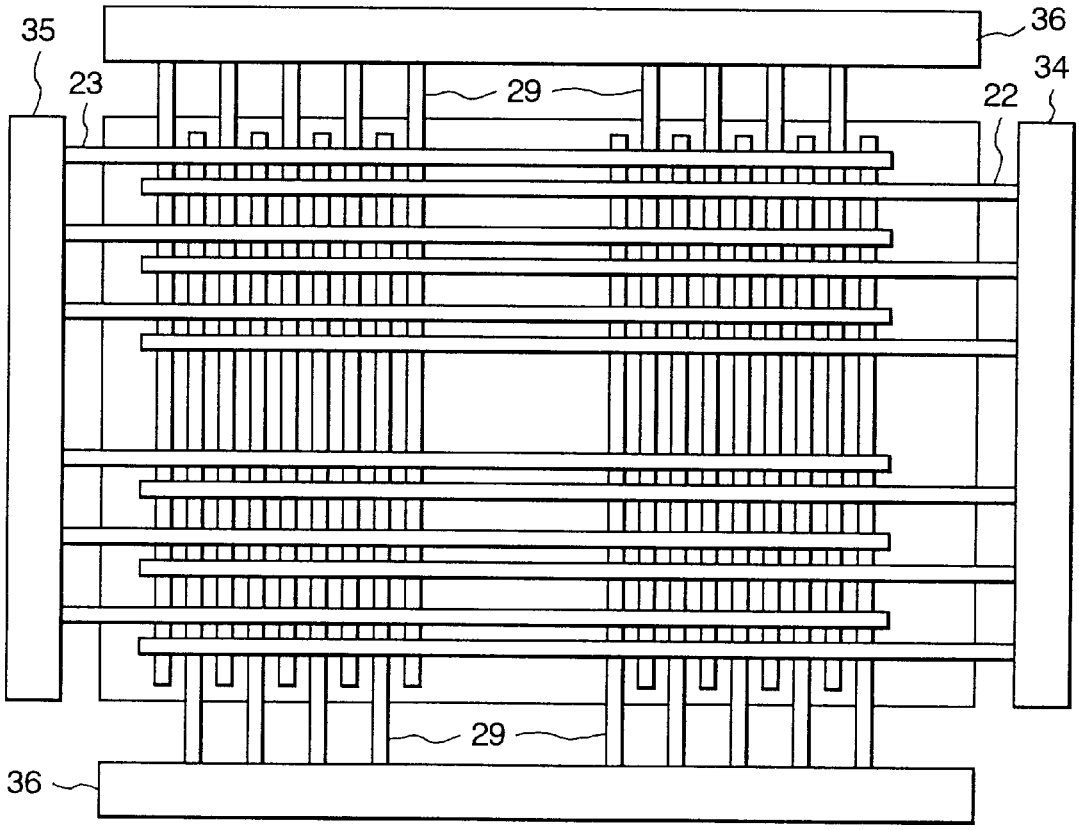
FIG. 5 is a block diagram of showing wiring of various electrodes in the plasma display device, as well as circuitry thereof.

FIG. 5 is a block diagram of showing wiring of the X electrodes 22, the Y electrodes 23 and the address A electrodes 29 in the plasma display device, as well as circuitry structure thereof. A X driver circuit 34 generates a driving pulse to be applied to the X electrodes 22, and a Y driver circuit 35, being connected to every one of the Y electrodes 31, generates a driving pulse to be applied to the Y electrodes 23. A pair of driver circuits 36, being connected to every other one of the address A electrodes 29, mutually, generate driving pulses to be applied to the address A electrodes 29.

Figure 6:
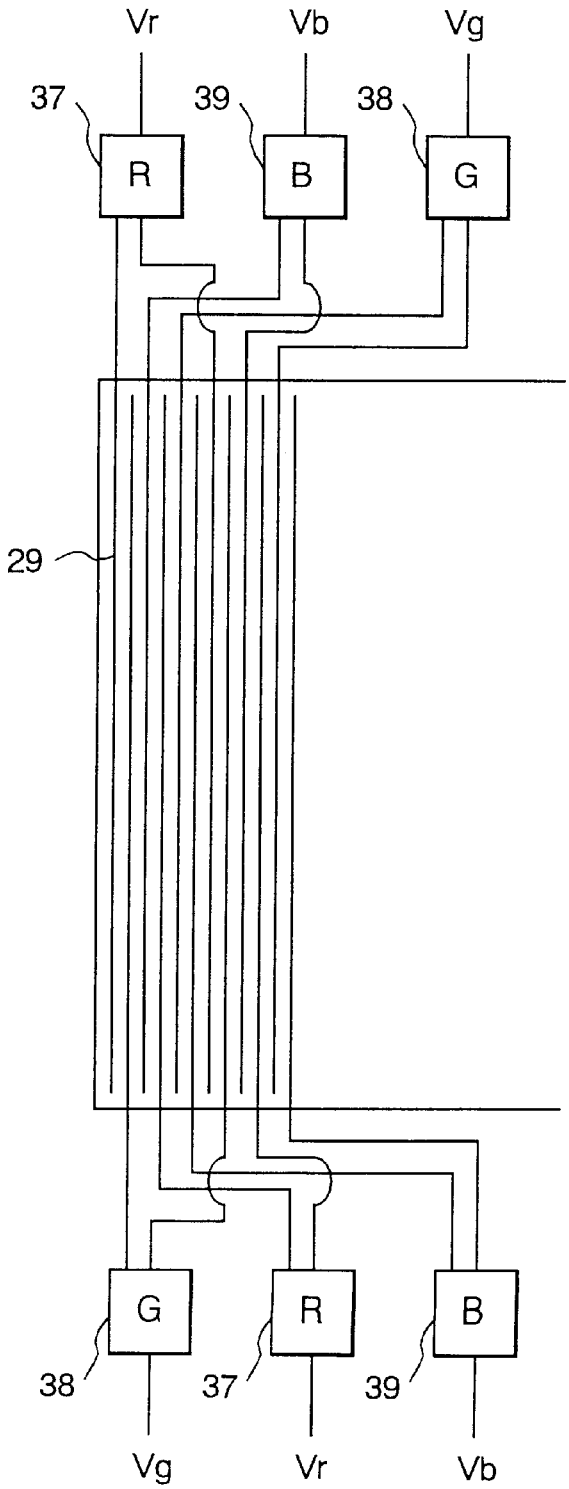
FIG. 6 is a block diagram of showing wiring of the address A electrode in the plasma display device, as well as circuitry structure thereof.

FIG. 6 is also a block diagram of showing wiring of the address A electrodes 29 in the plasma display device, as well as circuitry structure thereof. In the present embodiment, the three kinds of fluorescence are disposed in the order R, G and B from the left-hand side in the figure. Further, the address A electrodes 29 are extended in upper and lower directions of the panel, mutually, every two of them, and are connected to driver circuits, separated by the each color of the fluorescence, i.e., an address driver 37 for R. an address driver 38 for G, and an address driver 39 for B.

Figure 7:
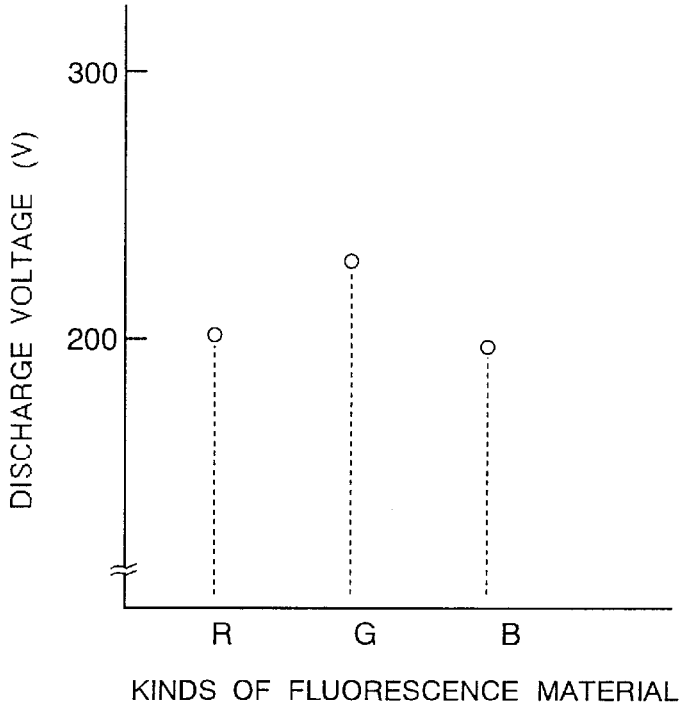
FIG. 7 shows a graph dotting result of measurement of the discharge voltages between the electrodes in a cell, for the respective colors of the fluorescence.

FIG. 7 shows a result of measurement of the discharge voltages between the Y electrode 23 and the address A electrodes 29 in each of the cells, for the respective colors of the fluorescence materials pasted therein. For an instance, the composition of the fluorescence materials used in the present measurement are, $(Y,Gd)BO_3$:Eu for R, $Zn_2SiO_4$:Mn for G, and $BaMgAl_{10}O_{17}$:Eu for B, however, it is only one example thereof. Among the three kinds of fluorescence materials, the discharge voltage of that for G is higher than the rests of them. However, among the other fluorescence materials for G, there is one which shows a discharge voltage lower than that. Further, the same is true to the fluorescence materials for R and B.

Figure 8:
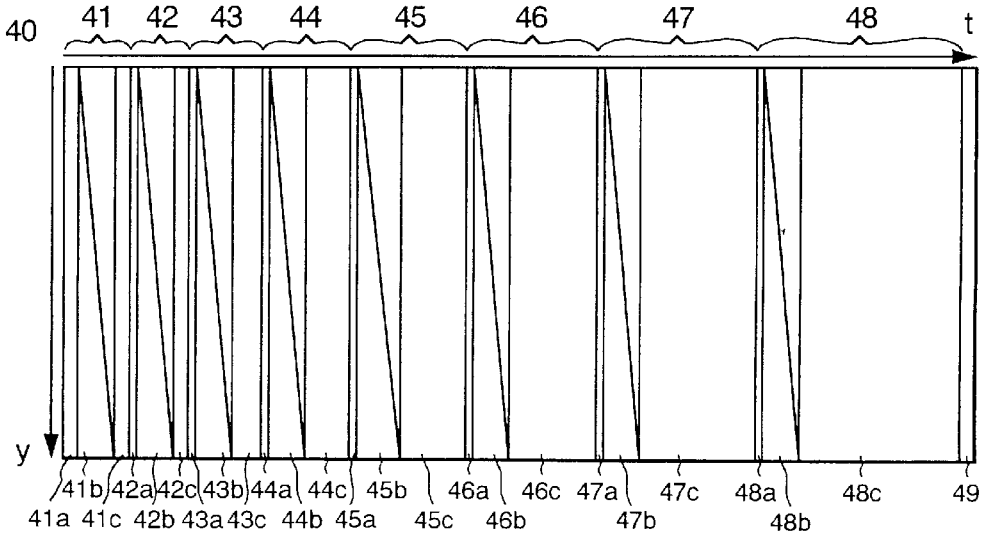
FIG. 8 shows a view of a field structure in the display operation of the plasma display panel according to the present invention.

FIG. 8 is a view of showing a field structure in the display operation of the plasma display panel according to the present invention. In the figure, a reference numeral 40 indicates a field term or period, and the horizontal axis and the vertical axis indicate a time t (1 field period) and a line y of the cells, respectively. In this case, one (1) field is further divided into eight (8) sub-fields, from a first sub-field 41 to an eighth sub-field 48, wherein the first sub-field 41 is assigned as the sub-field where the discharges occur at the minimum number of times and the other sub-fields are aligned sequentially therefrom in an order from smaller numbers of the discharge times. Following to the above, there are provided address periods 41*b* to 48*b* for regulating the cells to be displayed or to emit light, i.e., for addressing the cells to be displayed (in other words, addressing display of the cells), or alternatively, the address periods may be provided for non-addressing thereof (in other words, addressing non-display of the cells), in particular, in other type of plasma display panel with use of different display method. Further following to the above, there are provided sustain periods 41*c* through 48*c* for sustaining the discharging only in the cells in which the charges are constituted by the address discharge. To those sustain periods 43*c* through 48*c* for discharging, the numbers of the times of the discharges are assigned, respectively, and wherein, a display of a half tone can be obtained by a combination of those discharge numbers. However, the number of times of the discharges and the order thereof can be selected otherwise, arbitrarily, of course, there may be a sub-field in which the discharge is repeated by a large number of times.

Figure 1:
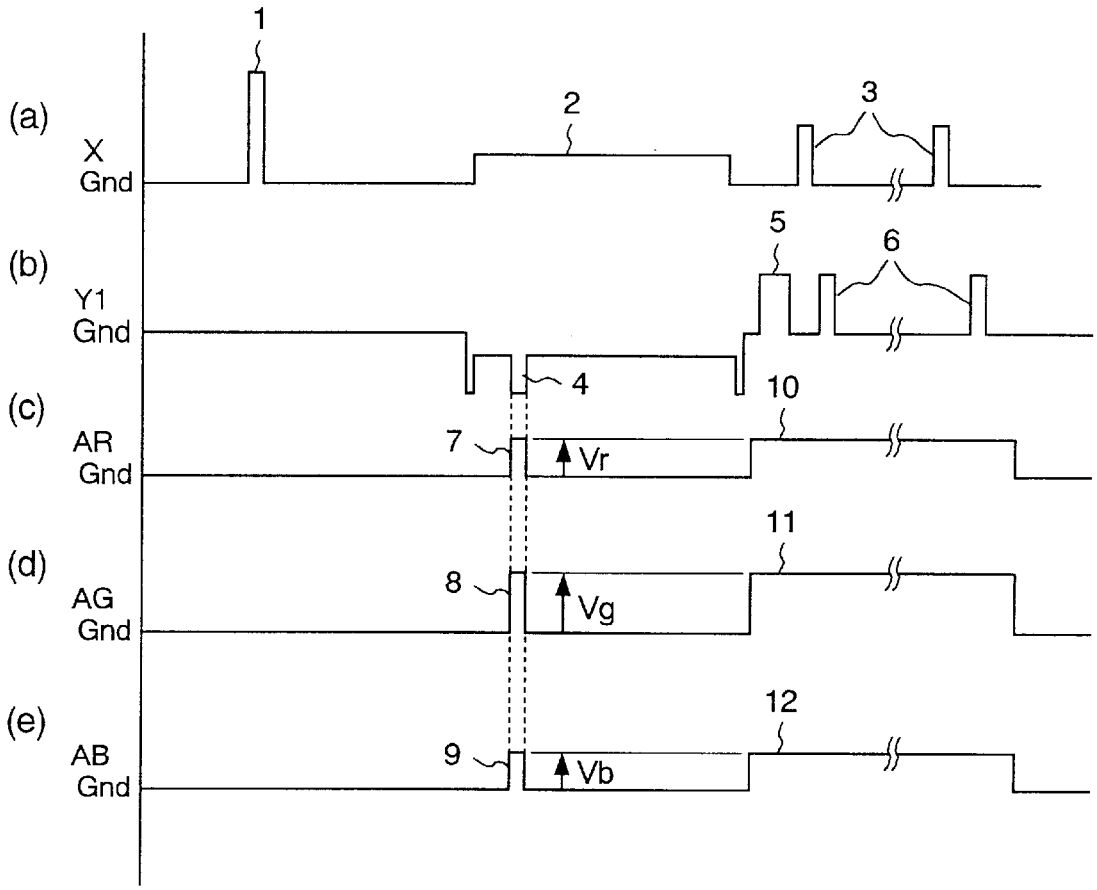
FIGS. 1 is a time chart for showing various wave-forms of a portion of driving signals during one of sub-fields, according to the present invention.

FIG. 1 is a time chart for showing various wave-forms of a portion of driving signals in one of the sub-fields, according to the present invention. Namely, FIG. 1(*a*) shows the wave-form of a portion of the driving signal which is applied to the every X electrode 22, and FIG. 1(*b*) shows the wave-form of a portion of the driving signal which is applied to one of the Y electrodes 23, in particular, for instance the first line (Y1) thereof. FIG. 1(*c*) through (*e*) show the wave-forms of portions of the driving signals which are applied to address A electrodes 29, i.e., the electrodes (AR, AG, AB) corresponding to the fluorescence materials, for example, red (R), green (G) and blue (B), respectively.

In a certain one sub-field 41, for instance, the wave-form of the signal applied to the every X electrode 22 is formed with a reset pulse 1 generated during the reset period 41*a*, a X scan pulse 2 during the address period 41*b*, and a X sustaining pulses 3 for sustaining the discharging during the sustain period 41*c*. At this instance, the reset pulse 1 is set at a voltage being higher than a break-down voltage of the discharge characteristic of the cells.

Next, the wave-form of the signal which is applied to the first line (Y1) of the Y electrodes, for instance, is formed with a scan pulse 4 during the address period 41*b*, a first sustaining pulse 5 during the sustain period 41*c*, and a Y sustaining pulse 6.

Next, the wave-form of a signal applied to the electrode corresponding to the fluorescence material for red (R) of the address A electrodes 29, for example, is formed with an address pulse 7 (a pulse for causing address charging) during the address period 41*b* corresponding to the cells to emit light (i.e., display), and a pulse 10 (called by "all-over pulse", hereinafter) corresponding to the sustaining pulse (the pulse for sustaining the address discharge). Further, the address pulse 7 and the all-over pulse 10 are set at the same or similar voltage of vr. The wave-forms of signals applied to the other electrodes which correspond to the fluorescence materials of green (G) and blue (B), in the same manner as for that of the red color, are also formed with address pulses 8, 9 during the address period 41*b*, and all-over pulses 11, 12 corresponding to the Sustaining pulses. And, the address pulse 8 and the all-over pulse 11 and the address pulse 9 and the all-over pulse 12 are set at the same or similar voltages to Vg and Vb, respectively. However, the voltages are set in an order of Vg, vr, Vb, corresponding to the respective heights of the charge voltages thereof, thereby changing voltages of a voltage source(s) supplied for the address drivers 37, 38 and 39 in the A driver circuit 36. Although it is apparent, however, the relationship in magnitudes of the discharge voltages among the fluorescence materials may be different depending upon the kinds or sorts thereof.

Next, explaining about the operations of the mentioned above, in the cells which are applied with the address pulses 7, 8 and 9 corresponding to the scan pulse 4, there occur the address discharges, thereby positive charged particle (i.e., of pulse polarity) is stored or accumulated on or around the dielectric layers 26 in the vicinity of the Y electrodes 23, while negative charged particle (i.e., of minus polarity) on or around the dielectric layers 26 in the vicinity of the X electrodes 22. only in the cells in which such the charged particles are stored, the discharge will occur continuously by the following first sustaining pulse 5, the Y sustaining pulse 6 and the X sustaining pule 3. In this instance, since the voltage in discharge occurring between the address electrode 29 and the Y electrode 23 differs depending upon the kinds or sorts (in particular, the colors) of the fluorescence materials, it is possible to cause the discharge in the cell which should occur the address discharge therein with certainty, by applying the voltage being appropriate for the respective discharge voltages for the colors, thereby obtaining a stable operation without erroneous discharge in the cells. in which the address discharge should not occur.

As mentioned in the above, it is possible to stabilize the discharge operation by changing the voltage which is applied to the address electrode 29 depending upon the difference in kinds or sorts of the fluorescence materials.

Figure 9:
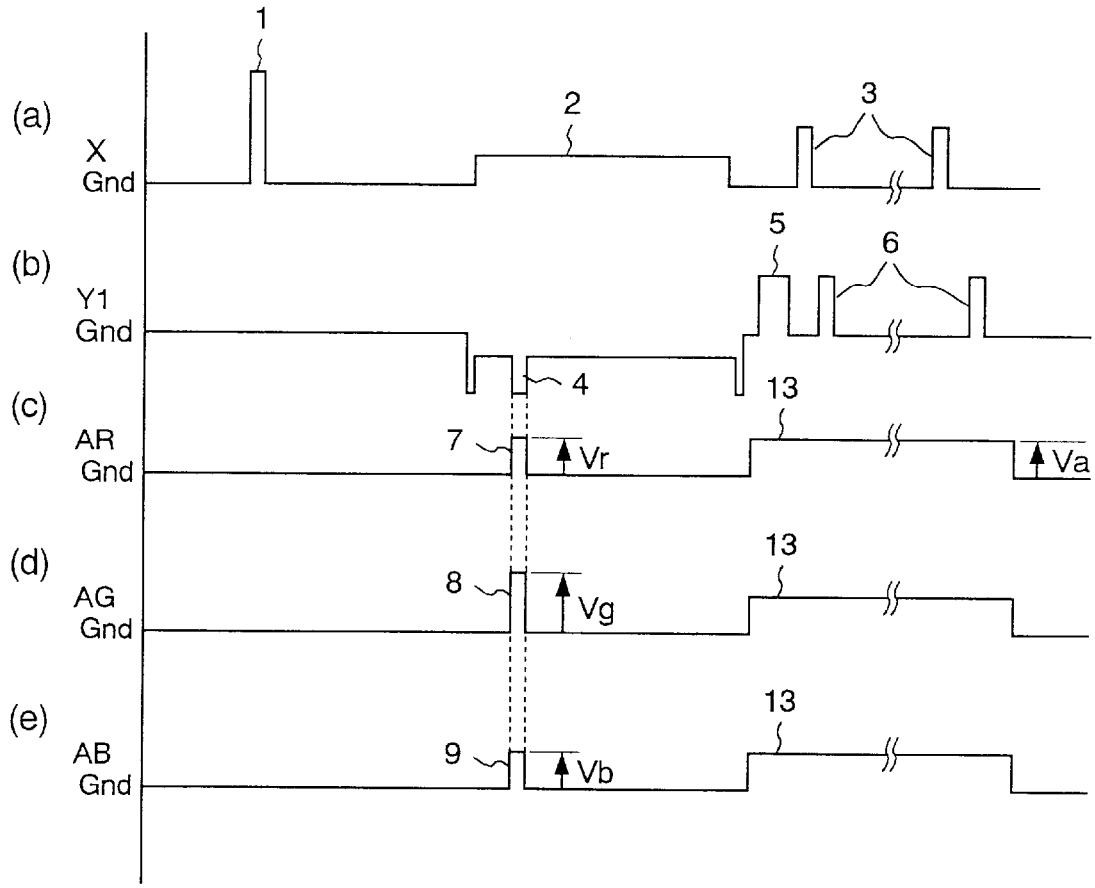
FIG. 9 is a time chart for showing various wave-forms of a part of the deriving signals in a one sub-field, in an another embodiment according to the present invention.

Next, an another embodiment of the present invention will be explained by referring to FIG. 9. FIG. 9 is a time chart for showing the wave-forms of a part of the deriving signals in a one sub-field, in the another embodiment. FIG. 9(*a*) shows the wave-form of a portion of the driving signal which is applied to the X electrode 22, and FIG. 9(*b*) shows the wave-form of a portion of the driving signal which is applied to the Y electrode 23, in particular, for instance the first line (Y1) thereof. FIGS. 9(*c*) through (*e*) show the wave-forms of portions of the driving signals which are applied to address A electrodes 29, i.e., the electrodes (AR, AG, AB) corresponding to the fluorescence, for example, red (R), green (G) and blue (B), respectively. However, the driving pulses which are same to those shown in FIG. 1 are attached with the same reference numerals or marks therein, and the explanation of them will be omitted. Further, the signals which are applied to the X electrode 22 and the Y electrode 23 in this FIG. 9 are same to those of the signals which are applied to them in FIG. 1, in the wave-form form thereof.

In this embodiment, among the wave-forms of the signals applied to the address A electrodes 29, the over-all pulse 13 during the sustain period is set at the voltage (Va) which is different from those of the address pulses 7, 8 and 9. This is because, since no discharge occurs by the over-all pulse during the sustain period, as well as there is no relationship with the voltage in the discharge occurring between the address electrodes 29 and the Y electrode 23, therefore, it is preferable to set the over-all pulse 13 at a voltage appropriate for the voltage of the sustaining pulse. However, with the voltage Va of the over-all pulse 13 and those voltages Vr, Vg, Vb of the address pulses for the respective colors, they may be set at the same or similar voltage to one another, or, alternatively, only some of the voltages Vr, Vg, Vb of the address pulses may be set to be equal or similar to the voltage Va of the all-over pulse 13.

As mentioned in the above, the stabilization in the discharge operation can be achieved by changing the voltage applied to the address electrodes 29 depending upon the sorts of the fluorescence material or the discharge characteristics of the address electrodes 29 of the cells, including difference in the characteristics of the fluorescence thereof, and further by determining the voltage of the over-all pulse 13 appropriately for the voltage of the sustaining pulse.

Figure 10:
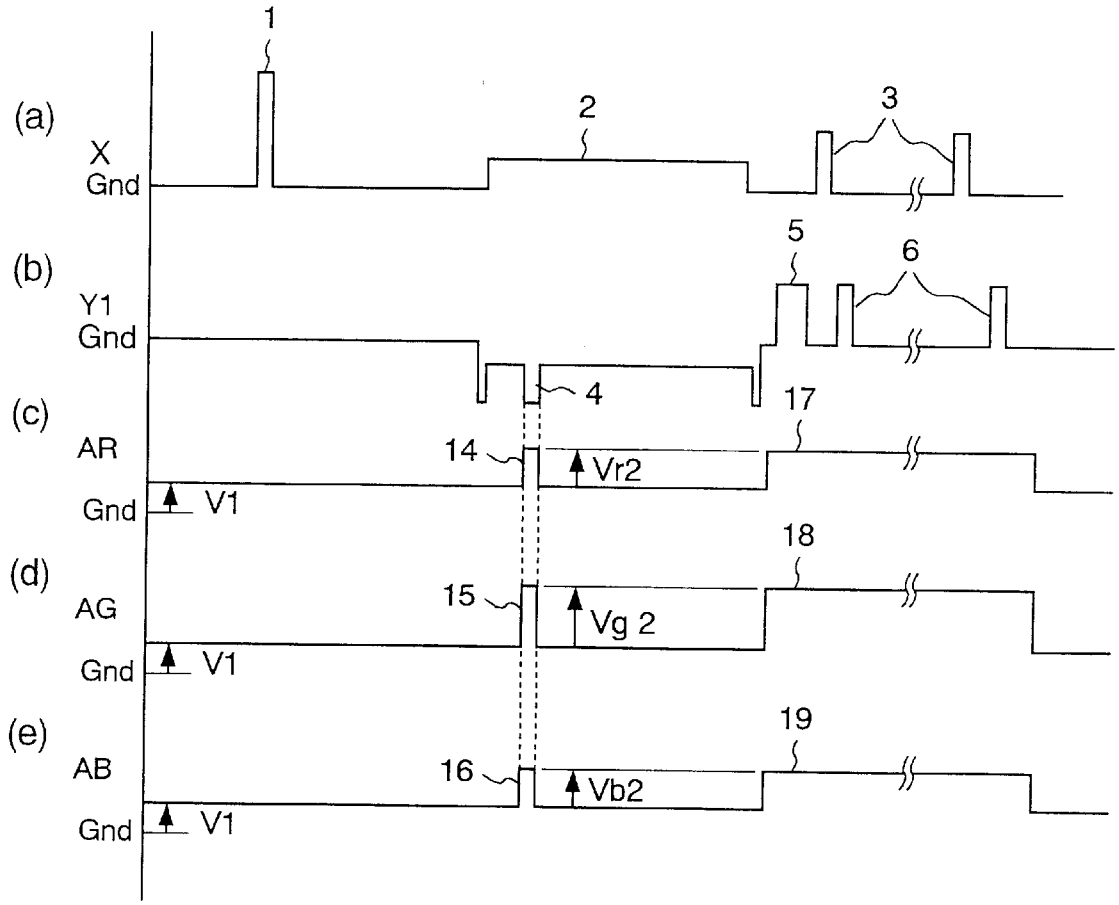
FIG. 10 is a time chart for showing various wave-forms of a part of the deriving signals in a one sub-field, in a third embodiment according to the present invention.

Next, a third embodiment of the present invention will be explained by referring to FIG. 10, hereinafter. FIG. 10 is a time chart for showing the wave-forms of a part of the deriving signals in a one sub-field, in the third embodiment. FIG. 10(*a*) shows the wave-form of a portion of the driving signal which is applied to the X electrode 22, and FIG. 10(*b*) shows the wave-form of a portion of the driving signal which is applied to the Y electrode 23, for instance the first line (Y1) thereof. FIG. 10(*c*) through (*e*) show the wave-forms of portions of the driving signals which are applied to address A electrodes 29, i.e., the electrodes (AR, AG, AB) corresponding to the fluorescence, for example, red (R), green (G) and blue (B), respectively. However, the driving pulses which are same to those shown in FIG. 1 are attached with the same reference numerals or marks therein, and the explanation of them will be omitted. Further, the signals which are applied to the X electrode 22 and the Y electrode 23 in this FIG. 10 are same to those of the signals which are applied to them in FIG. 1, in the wave-form thereof.

In this embodiment, among the wave-forms of the signals applied to the address A electrodes 29, an electric potential (i.e., a bias potential, for example, 40V the value of voltage) of V1 with respect to the ground potential (0V) of the circuitry is applied to them even in the time period when no such the address pulses 14, 15 and 16 and the all-over pulses 17, 18 and. 19 is applied thereto. Thereby, it is possible to make the respective voltages Vr2, Vg2, Vb2 of the address pulses 14, 15 and 16 lower than the voltage Vr, Vg, Vb of the address pulses (for example, 70V in the value of voltage) in the embodiments mentioned above, i.e., reducing down the change rates of them (from 70V down to 70−40=30V), as well as to decrease down the voltage-resistance necessary for the circuitry of driver elements therefor. Here, the bias potential V1 is set to be lower than the discharge voltage between the Y electrode 23.

Figure 11:
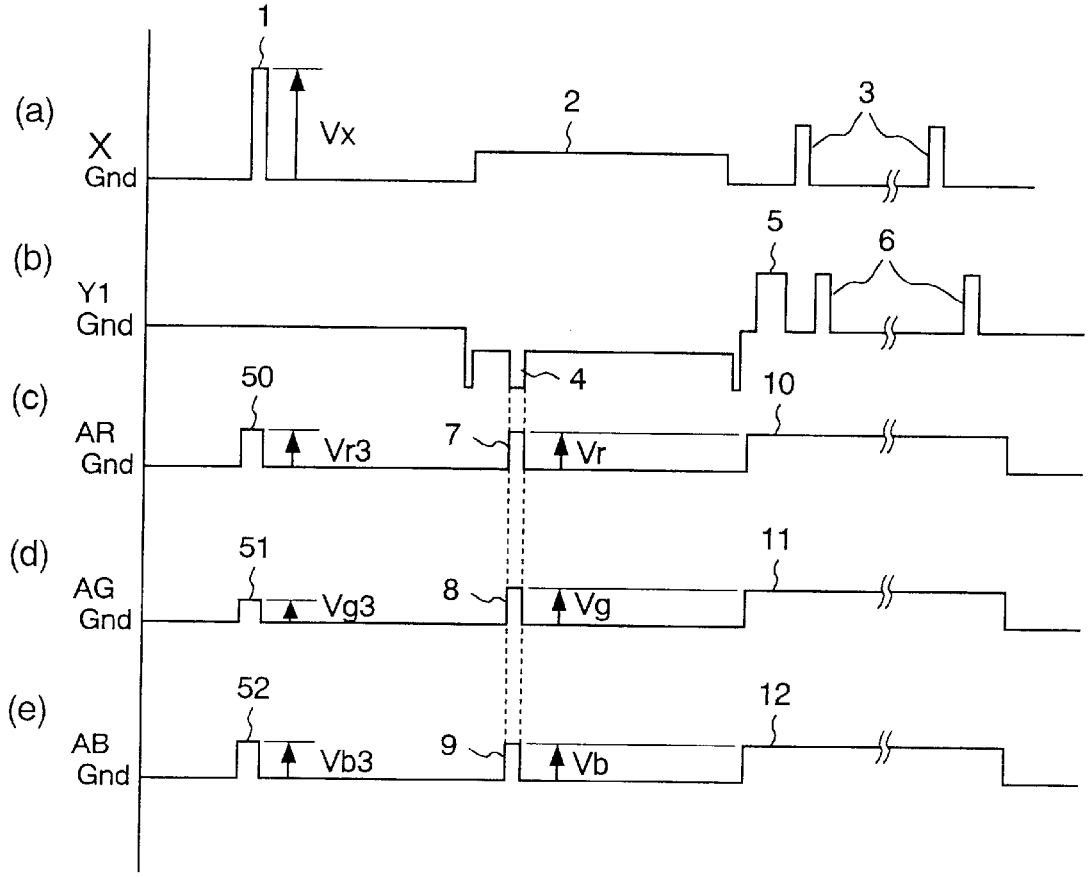
FIG. 11 is a time chart for showing various wave-forms of a part of the deriving signals in a one sub-field, in a fourth embodiment according to the present invention.

Next, a fourth embodiment of the present invention will be explained by referring to FIG. 11, hereinafter, FIG. 11 is a time chart for showing the wave-forms of a part of the deriving signals in a one sub-field, in the fourth embodiment. FIG. 11(*a*) shows the wave-form of a portion of the driving signal which is applied to the X electrode 22, and FIG. 11(*b*) shows the wave-form of a portion of the driving signal which is applied to the Y electrode 23, for instance the first line (Y1) thereof. FIGS. 11(*c*) through (*e*) show the wave-forms of portions of the driving signals which are applied to address A electrodes 29, i.e., the electrodes (AR, AG, AB) corresponding to the fluorescence, for example, red (R), green (G) and blue (B), respectively. However, the driving pulses which are same to those shown in FIG. 1 are attached with the same reference numerals or marks therein, and the explanation of them will be omitted. Further, the signals which are applied to the X electrode 22 and the Y electrode 23 in this FIG. 11 are same to those of the signals which are applied to them in FIG. 1, in the wave-form thereof.

To the address A electrodes 29 are applied pulses 50, 51 and 52 (called by "address reset pulse(s)", hereinafter) for effecting address reset in conformity with the reset pulse 1 during the reset period. Each of the voltages Vr3, Vg3, Vb3 of those address reset pulses is set in such a manner that the voltage difference from the voltage Vx of the reset pulse 1 does not exceed the discharge voltage of the respective fluorescence. In the case of the discharge voltages of the respective fluorescence as shown in FIG. 7, the respective voltages of the address reset pulses are set in an order Vb3, Vr3, Vg3 in the height of the voltage. With the address reset pulses, the reset discharge will occur with certainty between the X electrode 22 and the address A electrode 29 at the rising-up of the reset pulse 1, thereby stabilizing the operation thereof. Further, in the case where the voltages Vr3, Vg3, Vb3 of the address reset pulses are made equal or similar to the voltages Vr, Vg, Vb of the address pulses, respectively, at the respective address electrodes of the same kinds, there is an advantage that the voltage source can be used in common in the circuitry construction.

As is mentioned in the above, it is possible to stabilize the discharge operation, with application of the voltages to the address electrodes 29 depending upon the sorts of the luminescence medium, in particular upon the fluorescence, or the discharge characteristic of the address electrodes 29 including the fluorescence thereof.

As is fully described in the above, with the display device and the driving method thereof, it is possible to discharge the each of the address electrodes of the cells with a wide range of regulating voltage, thereby enabling the address discharge with ease certainly, and realizing the display of picture with high quality with inhibiting failure in the discharge.

What is claimed is:

1. A display device, comprising:

a plurality of cells of plural kinds of luminescence medium arranged on a plane for forming a display surface thereof, in which each of said cells comprises:

a pair of electrodes provided in parallel to each other;

an address electrode being positioned opposing said pair of electrodes; and a discharge space being defined between said pair of electrodes, said luminescence medium being provided on said address electrode, and said display device further comprising, a driving circuit for supplying address voltages to said address electrodes of said plural cells thereby causing charges for addressing display of said cells, wherein said driving circuit comprises plural circuits generating plural voltages of predetermined value corresponding to discharge characteristics of said plural kinds of said luminescence medium, wherein at least one of said plural voltages is different from others.

2. A display device, as described in claim 1, wherein said address voltages supplied from said address voltage generating circuit to said address electrodes are for addressing non-display of said cells instead of for addressing the display thereof.

3. A display device, as described in claim 1, wherein said cells are of at least three kinds, red (R), green (G), and blue (B) corresponding to said plural kinds of the luminescence medium, and further said address voltage generating circuit supplies said address voltages to at least two of said cells with the address voltages being different from each other.

4. A display device, as described in claim 1, wherein said luminescence medium in each of said cells is fluorescence material.

5. A display device, as described in claim 1, wherein said address voltages supplied from said address voltage generating circuit to said address electrodes of said cells are predetermined corresponding to the discharge characteristics that differ depending upon the kind of said fluorescence materials of said cells.

6. A display device, as described in claim 1, wherein the address voltages supplied to said address electrodes of said cells with said address voltage generating circuit are predetermined to be higher than break-down voltages which are inherent to said plurality of said cells.

7. A display device, as described in claim 1, wherein at least a part of said pair of electrodes in each of said cells is made of light-passing electrodes, and said address electrode is provided in a direction orthogonal to that of said pair of light-passing electrodes.

8. A display device, as described in claim 1, wherein each of the address voltages supplied from said address voltage generating circuit to said address electrodes comprises an address pulse which is generated corresponding to an address period in an operation and an over-all pulse which is generated corresponding to a sustain period, and at least said address pulse is predetermined depending upon the discharge characteristic of said cell to be addressed.

9. A display device, as described in claim 1, wherein said over-all pulse of the address voltage supplied from said address voltage generating circuit to said each address electrode is predetermined depending upon the discharge characteristic of said cell to be addressed.

10. A display device, as described in claim 8, wherein the address voltage supplied from said address voltage generating circuit to said each address electrode is further biased by a predetermined bias potential in a period other than that when said address pulse is turned on in said address period.

11. A display device, as described in claim 8, wherein said address voltage supplied from said address voltage generating circuit to said each address electrode further includes an address reset pulse which is generated corresponding to a reset period in advance to the address period, and said address reset pulse is also set at a voltage depending upon discharge characteristic of said cell to be addressed.

12. A driving method of a display device comprising:

an addressing step which supplies address voltages to address electrodes of plural cells of plural kinds of luminescence medium that are arranged on a plane for forming a display surface, by plural circuits which generate plural voltages of predetermined value corresponding to discharge characteristics of said plural kinds of luminescence medium, at least one of said plural voltages value is different from others, and each of said address electrodes of said plural cells is positioned opposite to said pair of electrodes which are provided in parallel to each other; and a sustaining step which applies sustaining pulses to said pair of electrodes to sustain an address discharge and to emit light in a discharge space defined between said pair of electrodes, and said luminescence medium being provided on each of said address electrodes.

13. A driving method of a display device, as described in claim 12 wherein said address voltages applied are for addressing non-display of said cells instead of for addressing the display thereof.

14. A driving method of a display device, as described in claim 12, wherein said cells are of at least three kinds, red (R), green (G), and blue (B) depending upon the luminescence mediums provided therein, and the address voltages supplied to at least two of the cells are different from one another.

15. A driving method of a display device, as described in claim 12, wherein said luminescence medium in each of said cells is fluorescence material, and said address voltages supplied from said address voltage generating circuit to said address electrodes of said cells for addressing are predetermined corresponding to the discharge characteristics that are different depending upon the kind of said fluorescence materials of said cells.

16. A driving method of a display device, as described in claim 12, wherein the address voltages supplied to said address electrodes of said cells for addressing are predetermined to be higher than break-down voltages which are inherent to said plural kinds of said cells.

17. A driving method of a display device, as described in claim 12, wherein each of the address voltages supplied from said address voltage generating circuit to said address electrodes includes an address pulse which is generated corresponding to an address period in an operation and an over-all pulse which is generated corresponding to a sustain period, and at least said address pulse is predetermined depending upon the discharge characteristic of said cell to be addressed.

18. A driving method of a display device, as described in claim 17, wherein said over-all pulse of the address voltage supplied to each of said address electrodes is predetermined depending upon the discharge characteristic of said cell to be addressed.

19. A driving method of a display device, as described in claim 17, wherein the address voltage supplied to each of said address electrodes is further biased by a predetermined bias potential in a period other than that where said address pulse is turned on in said address period.

20. A driving method of a display device, as described in claim 17, wherein said address voltage supplied to each of said address electrodes further includes an address reset pulse which is generated corresponding to a reset period in advance to the address period, and said address reset pulse is also set at a voltage depending upon discharge characteristic of said cell to be addressed.

* * * * *